US005483779A

United States Patent [19]

Crawford et al.

[11] Patent Number: 5,483,779

[45] Date of Patent: Jan. 16, 1996

[54] HEADER FRAME FOR A DISPLAY SYSTEM

[75] Inventors: John Crawford, Valrico, Fla.; Edward Boer, Flesherton, Canada

[73] Assignee: Exposystems, Inc., Tampa, Fla.

[21] Appl. No.: 88,885

[22] Filed: Jul. 8, 1993

[51] Int. Cl.[6] ..... E04C 2/40

[52] U.S. Cl. ..... 52/645; 52/36.1; 52/204.56; 52/656.1; 40/610; 135/151

[58] Field of Search ..... 40/610, 617; 160/135, 160/351, 352; 52/645–646, 648.1, 204.56, 656.1, 36.1, 36.4; 135/143, 148, 151

[56] References Cited

U.S. PATENT DOCUMENTS

| | | | |
|---|---|---|---|
| 253,520 | 2/1882 | Du Bois | 52/645 |
| 976,198 | 11/1910 | Merritt | 52/645 |
| 1,032,143 | 7/1912 | Katusky | 52/645 |
| 1,064,039 | 6/1913 | Wise | 40/610 |
| 1,479,799 | 1/1924 | Forsyth | 52/204.56 |
| 2,031,718 | 2/1936 | Kress | 211/182 |
| 2,187,870 | 1/1940 | Veccia | 40/610 |
| 2,499,747 | 3/1950 | Griffith | 52/645 |
| 5,058,359 | 10/1991 | Lindblom | 160/135 |

*Primary Examiner*—Carl D. Friedman
*Assistant Examiner*—Kevin D. Wilkens
*Attorney, Agent, or Firm*—Hodgson, Russ, Andrews, Woods & Goodyear

[57] ABSTRACT

A header frame for a display system which is easily and quickly erected without tools and which is collapsible to a compact shape for packing, storage, and transport. The header frame is disassembled to only four portions for packing, storage, and transport, i.e., two frame portion assemblies and two elongate connector assemblies. Each of the frame portion assemblies comprises a plurality of members joined to be U-shaped when the header frame is erected and hingedly connected to be collapsible compactly so that the members are parallel to and lie alongside each other. Thumbscrews are provided for detachably attaching the connector assemblies to the frame portion assemblies so that tools are not required for erection or disassembly of the header frame.

17 Claims, 3 Drawing Sheets

Fig. 1.
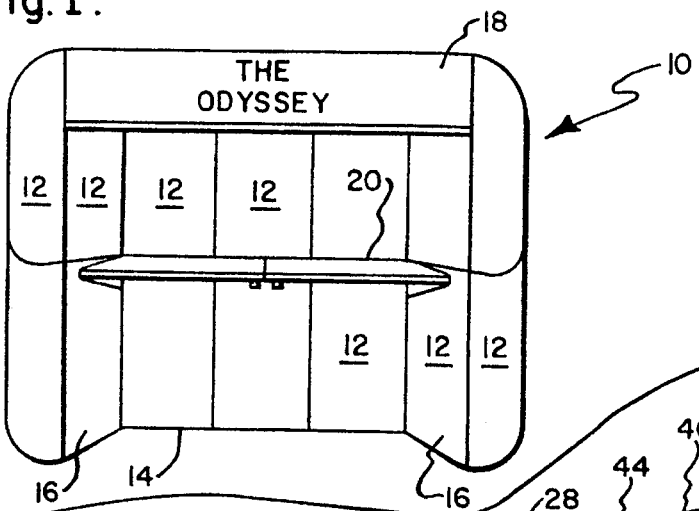
Fig. 2.
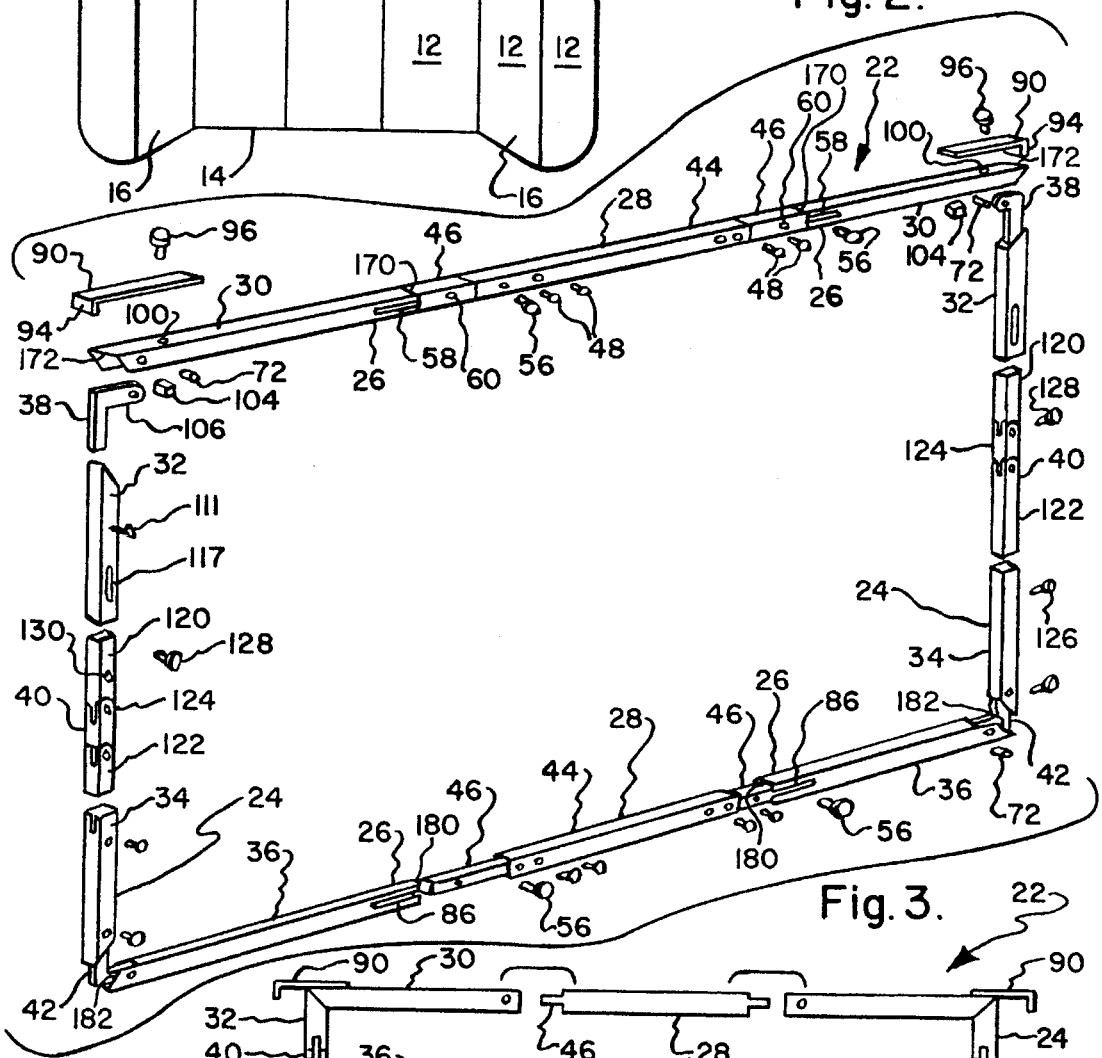
Fig. 3.
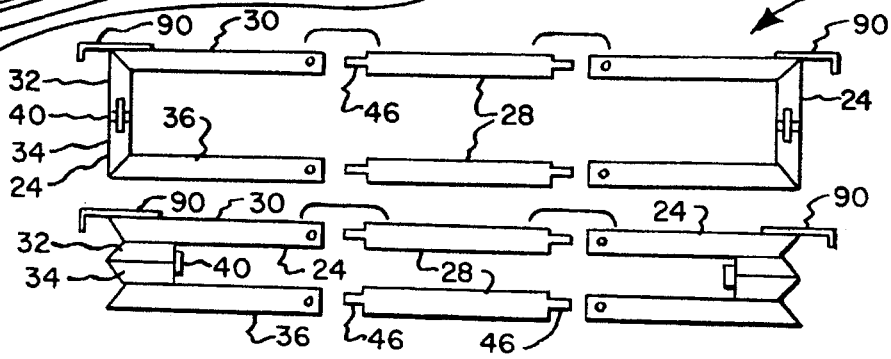
Fig. 4.

Fig. 5.
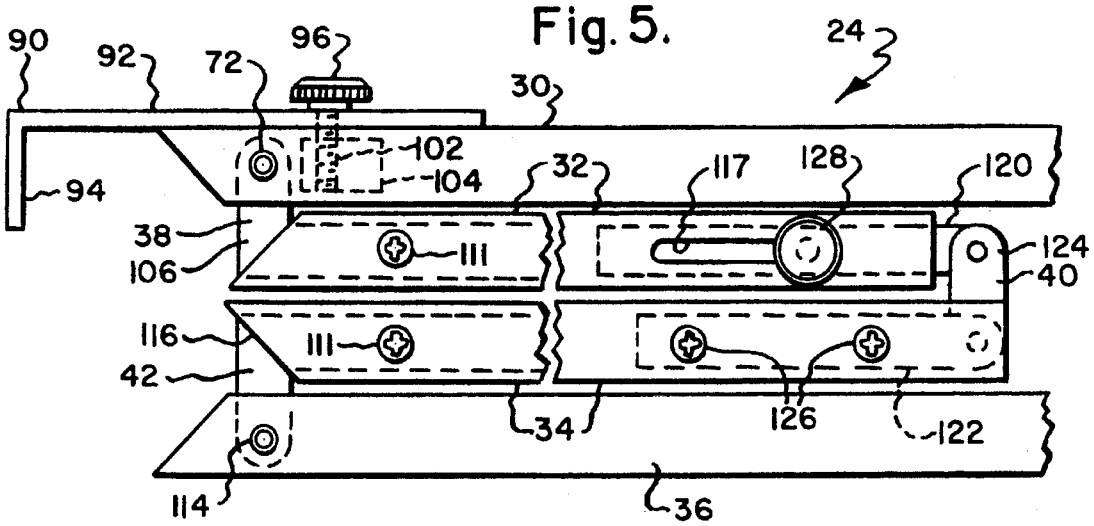
Fig. 6.
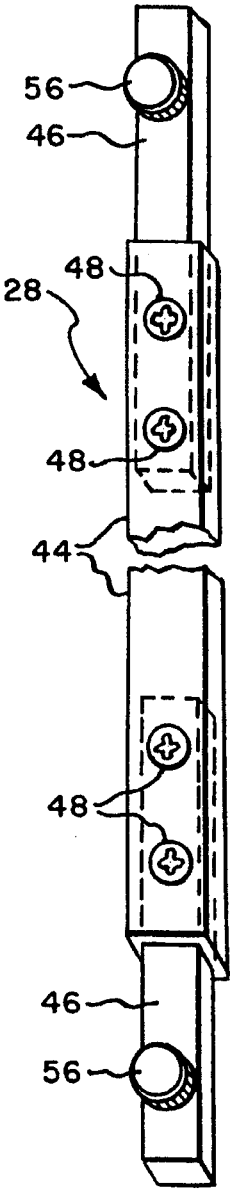
Fig. 7.
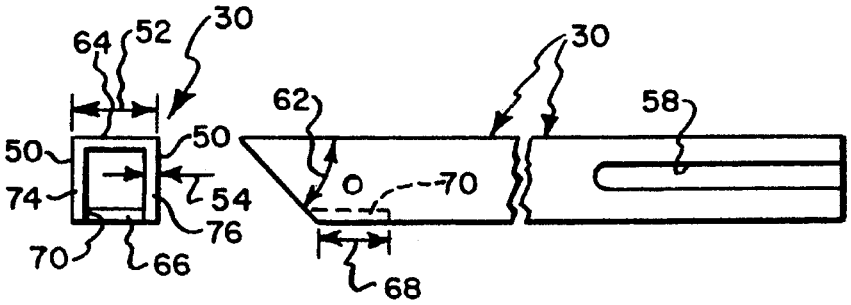
Fig. 8.
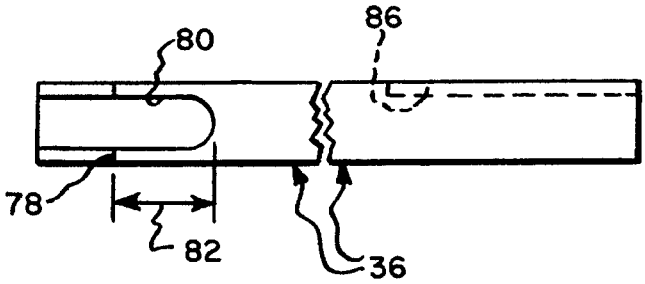
Fig. 9.

HEADER FRAME FOR A DISPLAY SYSTEM

The present invention relates generally to panel display structures for tradeshow exhibition booths and the like. More particularly, the present invention relates to a header for suspending photographs, printed signage, or the like between exhibit panels to headline a product or service offering. The header frame attaches to an existing display system panel or between two exhibit panels.

Typically, a header frame is rectangular in shape and may comprise perhaps six elongate pieces which are bolted together for set-up and are taken apart so that they take up a small amount of space for packing, storing, and shipping. Tools are required for this task, which is difficult and time consuming.

It is accordingly an object of the present invention to make the assembly and disassembly of a header frame easy, quick, and user-friendly.

It is a further object of the present invention to eliminate the need for tools for assembly and disassembly thereof.

In order to provide a header frame which is easy, quick, and user-friendly to assemble and disassemble, and without the need for tools, in accordance with the present invention a pair of frame portion assemblies are provided which comprise a plurality of frame members hingedly foldable to a compact shape. The frame portion assemblies are joined by a pair of connector portions or other suitable means which are detachable for set-up and take-down of the header. The total number of parts which must be connected or disconnected may thus be reduced to not more than four for easy, quick, and user-friendly assembly and disassembly.

The above and other objects, features, and advantages of the present invention will be apparent in the following detailed description of a preferred embodiment when taken in conjunction with the accompanying drawings wherein the same reference numerals denote the same or similar parts throughout the several views.

BRIEF DESCRIPTION OF THE DRAWINGS

FIG. 1 is a side view of a display system which incorporates a header frame which embodies the present invention.

FIG. 2 is a perspective blown-up view of a header frame for the display system of FIG. 1.

FIG. 3 is a schematic view of the header frame in the process of assembly.

FIG. 4 is a schematic view of the header frame in a folded collapsed condition for packing, storage, and/or shipment.

FIG. 5 is a side view of one of two frame portion assemblies therefor in the folded collapsed condition.

FIG. 6 is a perspective view of one of two connector portions for/connecting the frame portion assemblies.

FIG. 7 is a side view of an upper frame member of a frame portion assembly to which one of the connector portions is attachable.

FIG. 8 is an end view of the upper frame member.

FIG. 9 is a side view of a lower frame member of a frame portion assembly to which one of the connector portions is attachable.

DETAILED DESCRIPTION OF THE PREFERRED EMBODIMENT

Figure 10:
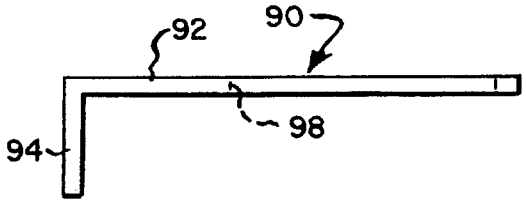
FIG. 10 is a side view of a hanger member for the header frame.

Referring to FIG. 1, there is illustrated generally at 10 a display system for a trade-show exhibition booth including a plurality of panels 12 connected to form a back wall 14 and a pair of forwardly extending sides 16. A header 18 is connected between the panels forming the sides 16 forwardly of the back wall 14 for highlining a service or product. The display system may also include a shelf 20 extending between the side panels or, alternatively, a front tower (not shown) or the like.

Referring to FIG. 2, there is illustrated generally at 22 a frame for the header 18. When the components thereof are connected together, the header frame 22 has a rectangular shape. Such a shape consumes a great deal of space. Thus, for packing, storing, and shipping, the frame 22 is desirably disassembled into a compact shape.

Referring to FIG. 3, in order to easily and quickly assemble and disassemble the frame 22, in accordance with the present invention the frame 22 is provided to comprise a pair of generally U-shaped frame portion assemblies 24 detachably connected at the end portions 26 thereof respectively by a pair of elongate connector assemblies 28.

Referring to FIG. 4, when the connectors 28 are disassembled therefrom, the frame portion assemblies 24 are collapsible to a compact shape, as also seen in FIG. 5, so that the four components 24 and 28 may, with a minimum of disassembly, be compactly packed, stored, and shipped.

Referring to FIGS. 2 to 5, each of the frame portion assemblies 24 includes four hingedly connected elongate rigid first, third, fourth and second members 30, 32, 34, and 36 respectively which are foldable about hinges 38, 40, and 42 to the collapsed form shown in FIG. 5.

Referring to FIG. 6, each of the pair of connector assemblies 28 includes a hollow elongate connector member 44 which is square in cross-section. In each end portion of member 44 is inserted, to a depth of perhaps about 38 mm., an end portion of a connector member 46 and attached thereto by suitable means such as, for example, two longitudinally-spaced self-tapping screws 48. Connector members 46 are sized to be snugly received in the hollow member 44.

Referring to FIGS. 7 and 8, the other end portions of the upper connector assembly connectors members 46 are insertable in end portions of hollow elongate members 30, which have a similar cross-section, illustrated in FIG. 8, to that of members 44. Thus, the cross-section of members 30 as well as members 44 is square with four walls 50 each having an outer width, illustrated at 52, which may perhaps be about 12.7 mm. and a thickness, illustrated at 54, of perhaps about 1.65 mm.

Each of the members 32, 34, and 36 has a cross-sectional shape and size which is similar to that of members 30. Each of the members 30, 32, 34, 36, 38, 40, 42, 44, and 46 is made of a suitable material, preferably of light weight, such as, for example, T-5 aluminum.

The respective connector members 46 are detachably attached to second ends 170 of first members 30 by suitable means such as thumbscrews 56 which are insertable in longitudinal slots, illustrated at 58, in one of the walls 50 of each of respective end portions containing second ends 170 of first members 30 and threadedly engage threaded apertures 60 in connector members 46 respectively, the slots 58 having a length, which may perhaps be about 28 mm., to allow length adjustability of the frame 22, and a width of perhaps about 4.7 mm. Thumbscrews 56 may be tightened hand-tight for easy and quick set-up as well as take-down of the frame 22. Slot 58 extends to and opens out the end of the respective member 30. Accordingly, for disassembly, the thumbscrew 56 may be loosened and menders 30 and 46 slid apart. The thumbscrews 56 may thereafter be tightened in apertures 60 to prevent their loss during storage and shipping. For assembly, the thumbscrews 56 may be loosened and the members 30 and 46 telescopingly slid together and thumbscrews 56 tightened hand-tight.

The other end portions containing first ends 172 of first members 30 are chamfered at an angle, illustrated at 62, of perhaps about 45 degrees with the upper wall 64, and a portion of the lower wall 66 over a distance, illustrated at 68, from the end thereof of perhaps about 11 mm. is removed to provide a recess 70 in which is receivable hinge member 38. Hinge member 38 is hingedly attached to member 30 by means of member 72, which may be a steel split pin or rivet or other suitable means which extends between and is permanently attached to sidewalls 74 and 76 of member 30 midway the width thereof and midway of the length of recess 70. Thus, split pin 72 may be located a distance of perhaps about 19 mm. from the end of the upper wall 64. Split pin 72 may perhaps be 3.2 mm. in diameter by 12.7 mm. long.

Members 36 have slots 86 similar to slots 58 in sidewalls in end portions thereof containing second ends 180 for detachable attachment to respective connector member 46 by means of respective thumbscrews 56. Referring to FIG. 9, the other end portions containing first ends 182 of lower members 36 are similarly chamfered at an angle of perhaps about 45 degrees from the lower wall thereof to a point, illustrated at 78, on the upper wall, and the upper wall has a recess 80 extending from the end of the upper wall longitudinally a distance, illustrated at 82, of perhaps about 18 mm. to a rounded end for receiving hinge member 42.

Figure 11:
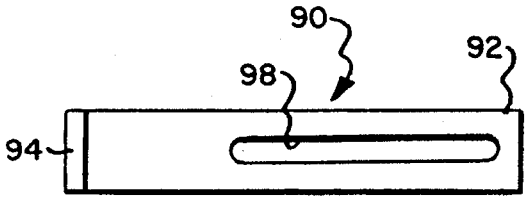
FIG. 11 is a top view of the hanger member.

Referring to FIGS. 10 and 11, the frame 22 is suitably mounted by means of mounting brackets 90 each of which includes a relative long portion 92 for engaging the upper wall 64 of respective upper member 30 and a relatively short downwardly-extending portion 94 (at right angles to portion 92) for disposition outwardly of the outer end of the respective member 30 for hooking onto a frame member of a side panel 16. The bracket 90 is attached by a thumbscrew 96 or other suitable means. For adjustment of the distance between hook portions 94, an elongate slot, illustrated at 98, is provided in long portion 92 centrally of the width thereof.

Figure 12:
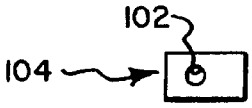
FIG. 12 is a top view of a blind nut used for attachment of the hanger member to the header frame.

Referring to FIG. 12, the thumbscrew 96 passes through slot 98 and through aperture 100 in the upper wall 64 of member 30 and is threadedly received in threaded aperture 102 of rectangular-shaped blind nut 104 which is located within the member 30 and is suitably attached therein such as by friction. For adjustment of the mounting brackets, the thumbscrews 96 may be loosened, the brackets 90 slid longitudinally of members 30 as desired, and the thumbscrews 96 tightened. The terms "upwardly" and "downwardly", for the purpose of this specification and the claims, are intended to be with reference to the location of the mounting brackets 90, which are along the upper portion of the frame 22.

Figure 13:
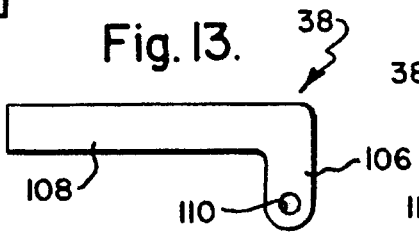
FIG. 13 is a side view of one of two corner hinge members for a frame portion assembly.
Figure 14:
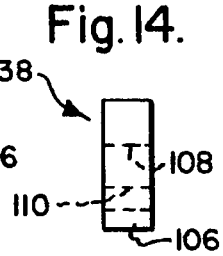
FIG. 14 is an end view of the corner hinge member.

Referring to FIGS. 13 and 14, there is shown hinge 38, it being understood that hinge 42 is similar thereto and is attached to ends of members 34 and 36 similarly as hinge 38 is attached to ends of members 30 and 32. Hinge 38 has a relatively short portion 106 and a relatively long portion 108 oriented at a right angle thereto. The outer end portion of the short portion 106 is rounded and contains an aperture 110 in which pin 72 is received for rotatable movement of hinge member 38 about pin 72 between a first or collapsed position shown in FIG. 5 and a second or erect position shown in FIG. 2. The long portion 108 is sized to be snugly or tightly received within a hollow end portion of member 32 and is attached thereto by self-tapping screw 111 or, if desired, a pair of such screws or other suitable means. The end portion of member 32 which receives hinge portion 108 is chamfered at an angle, illustrated at 112, of perhaps about 45 degrees to mate with the chamfered end portion of member 30 when the hinge 38 is in the second position. When in the second position, shown in FIG. 2, the short portion 106 extends horizontally in line with member 30, and the long portion 108 and member 32 extend in line vertically. The hinge 38 pivots about pin 72 to the first position, shown in FIG. 5, wherein the short portion 106 is oriented perpendicular to member 30 and extends through recess 70 and wherein long portion 108 with member 32 attached thereto extends compactly alongside member 30. Similarly, hinge 42 pivots about pin 114 and is attached to member 34 by self-tapping screw 111 or other suitable means wherein member 34 accordingly lies compactly alongside member 36 when in the collapsed position and is perpendicular to member 36 when in the erect position.

Figure 15:
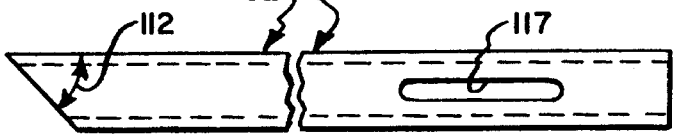
FIG. 15 is a side view of a frame portion assembly member which is attached to one of the corner hinge members.
Figure 16:
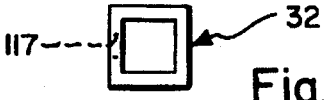
FIG. 16 is an end view of the frame portion assembly member of FIG. 15.
Figure 17:
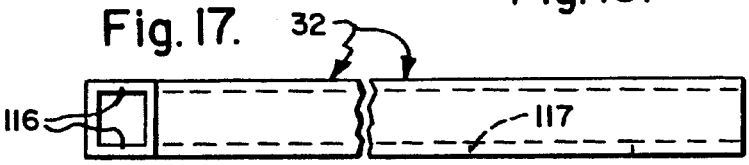
FIG. 17 is a bottom view of the frame portion assembly member of FIG. 15.

Referring to FIGS. 15, 16, and 17, the opposite end portion of member 32 has a longitudinal slot 117 in one of its walls, centrally thereof, for height adjustment of the frame 22. The slot 117 may have a length of perhaps about 28 mm. and terminate at a distance from the end of perhaps about 9 mm.

Figure 20:
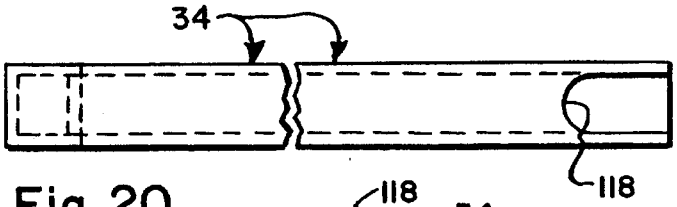
FIG. 20 is a top view of the frame portion assembly member of FIG. 18.
Figure 19:
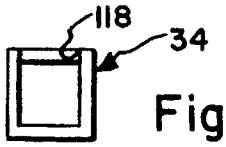
FIG. 19 is an end view of the frame portion assembly member of FIG. 18.
Figure 18:
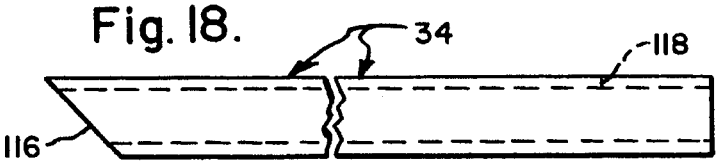
FIG. 18 is a side view of a frame portion assembly member which is attached to the other of the corner hinge members.

Referring to FIGS. 18, 19, and 20, member 34 has a chamfered end 116, of perhaps about 45 degrees, for mating with the chamfered end of member 36 when in the erect position, and a portion of one of its walls is removed over a distance from the opposite end of perhaps about 18 mm. to provide a recess, illustrated at 118, the inner end of which is rounded.

Figure 21:
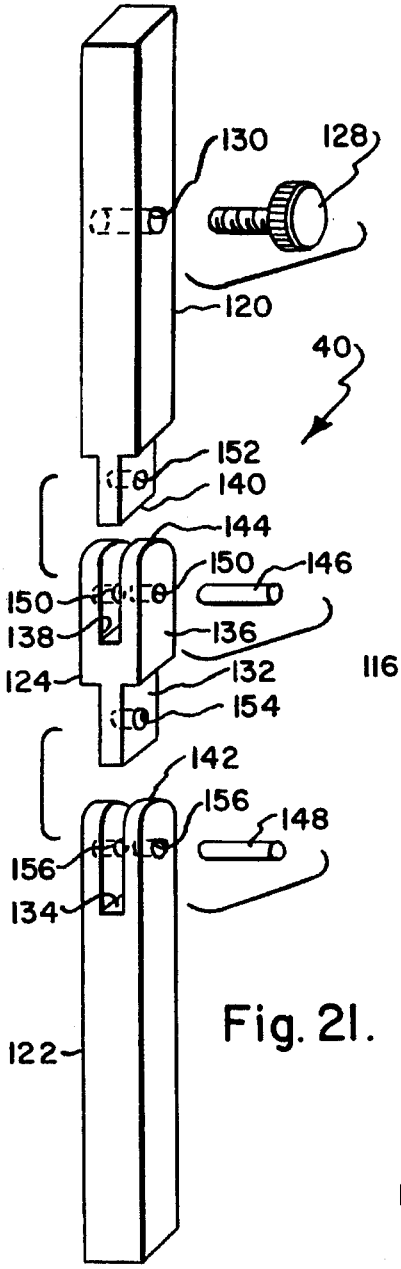
FIG. 21 is a perspective blown-up view of a hinge assembly connecting the frame portion assembly members of FIGS. 15 and 18.

Referring to FIG. 21, side hinge 40 comprises two relatively long members 120 and 122 and a relatively short member 124 hingedly or pivotly connecting end portions of long members 120 and 122. The opposite end portions of long members 120 and 122 are sized to be snugly or tightly received in the respective hollow end portions of members 32 and 34 respectively. Member 122 is attached to member 34 by a pair of longitudinally-spaced self-tapping screws 126 or other suitable means, the entire length of member 122 being received within member 34. Member 120 is adjustably attached to member 32 by means of thumbscrew 128 or other suitable means received in longitudinal slot 117 and threadedly received in threaded aperture 130 in member 120. For height adjustment of the frame 22, thumbscrew 128 may be loosened, members 32 and 120 slid longitudinally relative to each other to a desired adjustment, and the thumbscrew 128 tightened.

Member 124 is connected to members 120 and 122 by tongue-and-groove joints. Thus, one end portion of member 124 comprises a tongue 132 (portion of reduced thickness centrally of the width of member 124) which is received in a complementary groove 134 in the corresponding end of member 122 centrally thereof. The other portion of member 124 comprises a body 136 in the end of which is provided centrally a groove 138, similar to groove 134, for receiving complementary tongue 140, similar to tongue 132, on the corresponding end of member 120. The width of body 136 is equal to the widths of members 120 and 122 so that hinge 40 presents a uniform width over its length. The ends of members 122 and 124 containing the grooves 134 and 138 respectively are rounded, as indicated at 142 and 144 respectively, to permit pivoting movement between members 120 and 122 and member 124.

Members 120 and 124 are pivotly connected by a steel split pin or a roll pin 146 or other suitable means such as a rivet which passes through apertures 150 and 152 in the body 136 and tongue 140 respectively intermediate the ends and sides of the tongue 140 for pivoting or hinged movement between the first or collapsed position shown in FIG. 5 wherein members 120 and 124 are perpendicular to each other and the second or erected position shown in FIGS. 2 and 21 wherein members 120 and 124 are in line with each other. Similarly, members 122 and 124 are pivotly connected by a steel split pin or roll pin 148 or other suitable means such as a rivet which passes through apertures 154 and 156 in tongue 132 and end portion of member 122 respectively intermediate the ends and sides of tongue 132 for pivoting or hinged movement between the first or collapsed position shown in FIG. 5 wherein members 122 and 124 are perpendicular to each other and the second or erected position shown in FIGS. 2 and 21 wherein members 122 and 124 are in line with each other. Thus, when in the first or collapsed position, members 120 and 122 extend from member 124 in the same direction parallel to each other so that members 32 and 34 compactly extend parallel to and alongside each other. When in the second or erected position, members 120 and 122 are in line with each other so that members 32 and 34 are in line with each other.

In an exemplary embodiment, which is for the purposes of illustration and not limitation, connector assembly members 44 each may have a length of perhaps about 712 mm., with the centers of the apertures for self-tapping screws 48 being perhaps about 12.5 and 25 mm. respectively from the end, each of the spigots 46 may have a length of perhaps about 76 mm. and its end received in member 30 or 36 perhaps chamfered, member 32 may have a length of perhaps about 184 mm., slot 117 may have a length of perhaps about 28 mm. and be located a distance of perhaps about 9 mm. from the end of member 32, member 34 may have a length of perhaps about 196 mm., recess 118 may extend over a length of perhaps about 18 mm., members 30 and 36 may each have a length of perhaps about 838 mm., slots 58 and 86 may each have a length of perhaps about 28 mm. and a width of perhaps about 4.7 mm., bracket 90 may have a width of perhaps about 12.7 mm. equal to the widths of the sides of members 30, 32, 34, and 36 which are all square in section, the length of long portion 92 may perhaps be about 76 mm., the length of short portion 94 may perhaps be about 19 mm., slot 98 may have a length of perhaps about 46 mm. and a width of perhaps about 4.7 mm., blind nut 104 may have a section perhaps about 9 mm. square and a length of perhaps about 12 mm. with the center of aperture 102 located from one end a distance of perhaps about 4.5 mm., tongues 132 and 140 may each have a length of perhaps about 10 mm., member 120 may have an overall length of perhaps about 70 mm., member 122 may perhaps have an overall length of perhaps about 60 mm., member 124 may have a length of perhaps about 24 mm., members 120, 122, and 124 may each perhaps have a width of about 9 mm., corner hinges 38 may each have a length of long portion 108 of perhaps about 50 mm. and a length of short portion 106 of perhaps about 19 mm., the center of aperture 110 being perhaps about 3 mm. from the end. The frame members and hinges may be composed, for example, of 6063-1 T-5 aluminum (perhaps 6063 (6061) T5 aluminum for member 34). Steel tape may, for example, be applied to the back side of the frame 22 and around the entire perimeter thereof and splices. Self-tapping screws 126 may perhaps be No. 8 self-tapping Phillips flat head Type F. Screws 111 may perhaps be 8-32 Type F Phillips flat head screws. Thumbscrews 128 may perhaps be 8–32 by ⅜ inch. Thumbscrew 56 may perhaps be 8–32⅛ inch. The self-tapping screws 48 may perhaps be 8–32×⅜ inch Type F flat head. The thumbscrews 96 may perhaps be 8–32 by ½ inch. The split pins 146 and 148 may perhaps be 3.2 mm. in diameter by 9 mm. long. The split pins 72 and 114 may perhaps be 3.2 mm. by 12.7 mm.

The frame may be quickly and easily erected, without the need for tools, by unfolding the frame portion assemblies 24 to the generally U-shaped configuration shown in FIG. 2 and the two connector assemblies 28 attached by inserting the spigots 46 in members 30 and 36 respectively and tightening the four thumbscrews 56 after adjusting the length as allowed by slots 58 and 86. The height may be adjusted by loosening the thumbscrews 128 and sliding members 32 longitudinally relative to hinge members 120 as allowed by slots 117 and thereafter tightening the thumbscrews 128. For quick and easy disassembly, the connector assemblies 28 may be easily removed after the thumbscrews 56 are loosened, and the frame portion assemblies 24 each collapsed into the compact shape of FIG. 5 by pivoting hinge members 38 and 42 about pins 72 and 114 respectively and pivoting hinge members 120 and 122 about pins 146 and 148 respectively until members 30, 32, 34, and 36 compactly lie alongside and adjacent each other.

It should be understood that while the invention has been described in detail herein, the invention can be embodied otherwise without departing from the principles thereof, and such other embodiments are meant to come within the scope of the present invention as defined in the appended claims.

What is claimed is:

1. A header frame for a display system comprising a pair of frame portion assemblies, means for detachably joining said frame portion assemblies so that the header frame has a rectangular shape for set-up an take-down of the header, each of said frame portion assemblies including a plurality of frame members and hinge means for folding said frame members relative to each other so that said frame portion assemblies are foldable to a compact shape, and means for mounting the header frame in a display system, wherein said joining means comprises a pair of elongate members and means for attaching each of said elongate members to respective end portions of said frame portion assemblies.

2. A header frame according to claim 1 wherein said mounting means comprises a pair of brackets having hook portions and thumbscrew means and slot means extending longitudinally in said brackets for receiving said thumbscrew means for attaching said brackets to said frame portion assemblies respectively and for adjusting the distance between said hook portions.

3. A header frame according to claim 1 wherein said attaching means comprises a pair of connector members each having a pair of end portions one of which is inserted in and attached to an end portion of said respective elongate member and the other of which is insertable in a respective end portion of one of said frame portion assemblies, and thumbscrew means for detachably attaching said connector members to said frame portion assemblies respectively.

4. A header frame according to claim 3 further comprising slot means in at least one of said frame portion assemblies for receiving said thumbscrew means for adjusting a length of the header frame.

5. A header frame for a display system comprising a pair of frame portion assemblies, means for detachably joining said frame portion assemblies so that the header frame has a rectangular shape for set-up and take-down of the header, each of said frame portion assemblies including a plurality of frame members and hinge means for folding said frame members relative to each other so that said frame portion assemblies are foldable to a compact shape, and means for mounting the header frame in a display system, wherein each said frame portion assembly comprises first and second members for extending horizontally and third and fourth members for extending vertically in end-to-end relationship when the header frame is erected, a pair of means for hingedly connecting first end portions of said first and second members to first end portions of said third and fourth members respectively and for hingedly connecting second end portions of said third and fourth members so that said frame member assembly is foldable compactly such that said first, second, third, and fourth members are parallel to and lie alongside each other.

6. A header frame according to claim 5 comprising a hinge assembly for connecting said third and fourth members, said hinge assembly comprising a pair of hinge members connected to said third and fourth members and an intermediate hinge member and further comprising a pair of joint means connecting said intermediate hinge member to said pair of hinge members respectively.

7. A header frame according to claim 6 further comprising thumbscrew means and longitudinal slot means in one of said third and fourth members for receiving said thumbscrew means for attaching one of said pair of hinge members to said one of said third and fourth members for adjusting the height of the header frame.

8. A header frame according to claim 6 wherein one of said joint means comprises a first tongue on one of said pair of hinge members, first groove means in said intermediate hinge member for receiving said first tongue, and pin means for pivotly connecting said first tongue and said first groove means, the other of said joint means comprising a second tongue on said intermediate hinge member, second groove means on an other of said pair of hinge members for receiving said second tongue, and pin means for pivotly connecting said second tongue and said second groove means.

9. A header frame according to claim 5 wherein said joining means comprises a pair of elongate members for extending horizontally when the header frame is erected, means for attaching one of said pair of elongate members to second end portions of said first members of said pair of frame portion assemblies, and means for attaching the other of said pair of elongate members to second end portions of said second members of said pair of frame portion assemblies.

10. A header frame according to claim 5 wherein said mounting means comprises a pair of brackets having hook portions and thumbscrew means and slot means extending longitudinally in said brackets for receiving said thumbscrew means for attaching said brackets to said first members respectively and for adjusting the distance between said hook portions.

11. A header frame according to claim 5 wherein said joining means comprises a pair of elongate members for extending horizontally when the header frame is erected, a plurality of connector members attached to end portions of said pair of elongate members respectively and having end portions insertable in end portions respectively of said first and second members, and thumbscrew means for detachably attaching said connector members to said first and second members respectively.

12. A header frame according to claim 11 further comprising slot means extending longitudinally in said first and second members for receiving said thumbscrew means respectively for adjusting a length of the header frame.

13. A collapsible header frame for a display system comprising a pair of frame portion assemblies each including first, second, third, and fourth elongate members, means for hingedly connecting said elongate members in end-to-end relationship such that, when the header frame is erected, said first and second elongate members extend horizontally and parallel to each other and said third and fourth elongate members extend vertically and in line with each other between first ends of said first and second elongate members, a pair of elongate first connector members, means for detachably attaching one of said first connector members to second ends of said first elongate members of said pair of frame portion assemblies and the other of said first connector members to second ends of said second elongate members of said pair of frame portion assemblies whereby, when the header frame is erected, the header frame has a rectangular shape and, when said first connector members are detached therefrom, each of said frame portion assemblies is collapsible to a compact shape wherein said first, second, third, and fourth elongate members are parallel to and extend alongside each other, the header frame further comprising means for mounting the header frame in a display system.

14. A header frame according to claim 13 wherein said mounting means comprises a pair of brackets having hook portions and means for attaching said brackets to said first elongate members respectively for adjusting the distance between said hook portions.

15. A header frame according to claim 13 wherein said means for detachably attaching said first connector members comprises second connector members attached to end portions of said first connector members and having end portions which are insertable in end portions of said first and second elongate members respectively, and thumbscrew means for detachably attaching said second connector members to end portions of said first and second elongate members respectively.

16. A header frame according to claim 13 further comprising means for adjusting the length and height of the header frame.

17. A header frame according to claim 13 wherein each of said frame portion assemblies includes a pair of tongue-and-groove joint means for hingedly connecting said third and fourth elongate members.

* * * * *